US006174579B1

(12) United States Patent
Slyster et al.

(10) Patent No.: US 6,174,579 B1
(45) Date of Patent: Jan. 16, 2001

(54) TWO WAY MAILED DOCUMENT WITH TWO SIDED VARIABLE COLOR INFORMATION

(75) Inventors: John F. Slyster, Lockport; Jimmie A. Harrod, Grand Island; Larry M. Chism, Grand Island; David S. Fisher, Grand Island, all of NY (US)

(73) Assignee: Moore Business Forms, Inc., Grand Island, NY (US)

( * ) Notice: Under 35 U.S.C. 154(b), the term of this patent shall be extended for 0 days.

(21) Appl. No.: 09/232,226

(22) Filed: Jan. 19, 1999

Related U.S. Application Data

(62) Division of application No. 08/773,331, filed on Dec. 24, 1996, now Pat. No. 5,921,065.

(51) Int. Cl.[7] ..... B42D 15/00

(52) U.S. Cl. ..... 428/40.1; 283/56; 283/67; 283/99; 283/106; 283/115; 283/116; 428/41.6; 428/41.8; 428/42.1; 428/42.2; 428/42.3; 428/130; 428/914

(58) Field of Search ..... 428/40.1, 41.6, 428/41.8, 42.1, 42.2, 42.3, 914, 130; 283/56, 116, 115, 99, 67, 106

(56) References Cited

U.S. PATENT DOCUMENTS

| | | | | |
|---|---|---|---|---|
| 3,275,316 | * | 9/1966 | Cleary, Jr. | 283/105 |
| 3,618,284 | * | 11/1971 | Gendron | 493/187 |
| 4,010,964 | * | 3/1977 | Schechter | 283/56 |
| 4,676,526 | * | 6/1987 | Redman | 281/5 |
| 4,781,322 | * | 11/1988 | Humm | 283/81 |
| 4,931,035 | * | 6/1990 | Schmidt | 493/249 |
| 5,068,742 | * | 11/1991 | Oshikoshi et al. | 283/77 |
| 5,129,682 | * | 7/1992 | Ashby | 283/81 |
| 5,232,248 | * | 8/1993 | Talbott | 283/81 |
| 5,234,231 | * | 8/1993 | Hollander et al. | 283/34 |
| 5,263,637 | * | 11/1993 | Simson | 493/187 |
| 5,324,153 | * | 6/1994 | Chess | 283/81 |
| 5,344,190 | * | 9/1994 | Volz | 283/71 |
| 5,397,623 | * | 3/1995 | Christy et al. | 428/195 |
| 5,456,646 | * | 10/1995 | Crowley | 493/187 |
| 5,482,328 | * | 1/1996 | Stewart | 283/81 |
| 5,487,566 | * | 1/1996 | Hedge, Jr. | 283/56 |
| 5,547,227 | * | 8/1996 | Laurash et al. | 283/81 |
| 5,603,529 | * | 2/1997 | Breindel | 493/188 |
| 5,803,889 | * | 9/1998 | Littman | 493/216 |

OTHER PUBLICATIONS

Xeikon DCP–1 Short–run Digital Color Press "Color On Demand"©1993 brochure.*

* cited by examiner

*Primary Examiner*—Nasser Ahmad
(74) *Attorney, Agent, or Firm*—Nixon & Vanderhye P.C.

(57) ABSTRACT

A mailing envelope with a plurality of inserts is made by imaging variable color indicia on both faces of a paper substrate and imaging sense marks, and reply indicia, on at least one face of the substrate. The sense marks are used to properly align and slit the substrate web into a web of pre-determined width (removing the sense marks), and then label portions are flexographically printed on the first face of the web with magnetic ink. Adhesive and a release liner (e.g. using transfer tape) are applied to the second face of the web at the label portions and the labels are die cut from the label portions. The web is cut into sheets of predetermined length, each sheet including at least one set of labels, and the sheet is buckle folded to form a folded sheet with a plurality of panels in the sheet, at least one panel having a set of labels. The folded sheet is then trimmed to form at least two distinct inserts from the folded sheet, at least one distinct insert comprising a reply insert with reply indicia on it. The inserts are inserted, with a reply envelope, into an outgoing envelope to produce a mailing envelope. Typically the folded sheet has at least four panels, including at least two aligned fold lines, and trimming is accomplished by severing the sheet at the aligned fold lines to form at least three different inserts, at an inserter.

17 Claims, 4 Drawing Sheets

UNWIND
17
SNUBBER
18
15
19
SLITTER
20
FLEX. PRINTER
21
WINDOW PATCH UNIT
22
15
DIE CUTTER
23
15
CUT OFF MODULE
31
TAKE AWAY
32
BUCKLE FOLDER
33
64
35
36
WIND
16
15
COLOR PRINTER
13
WEB
11
12
10
73
37
42
41
39
38
CHOPPER
40

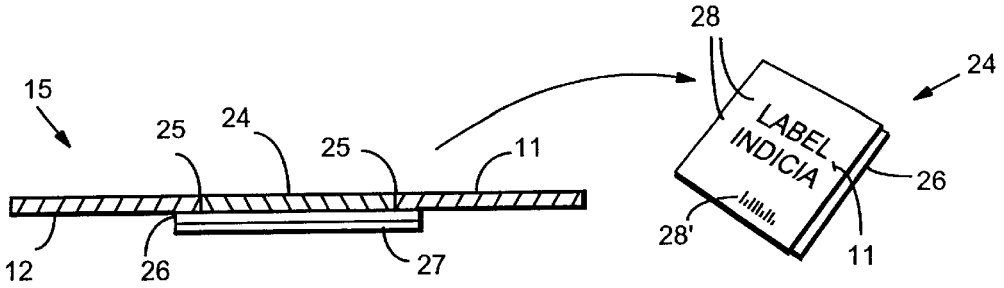
Fig.5
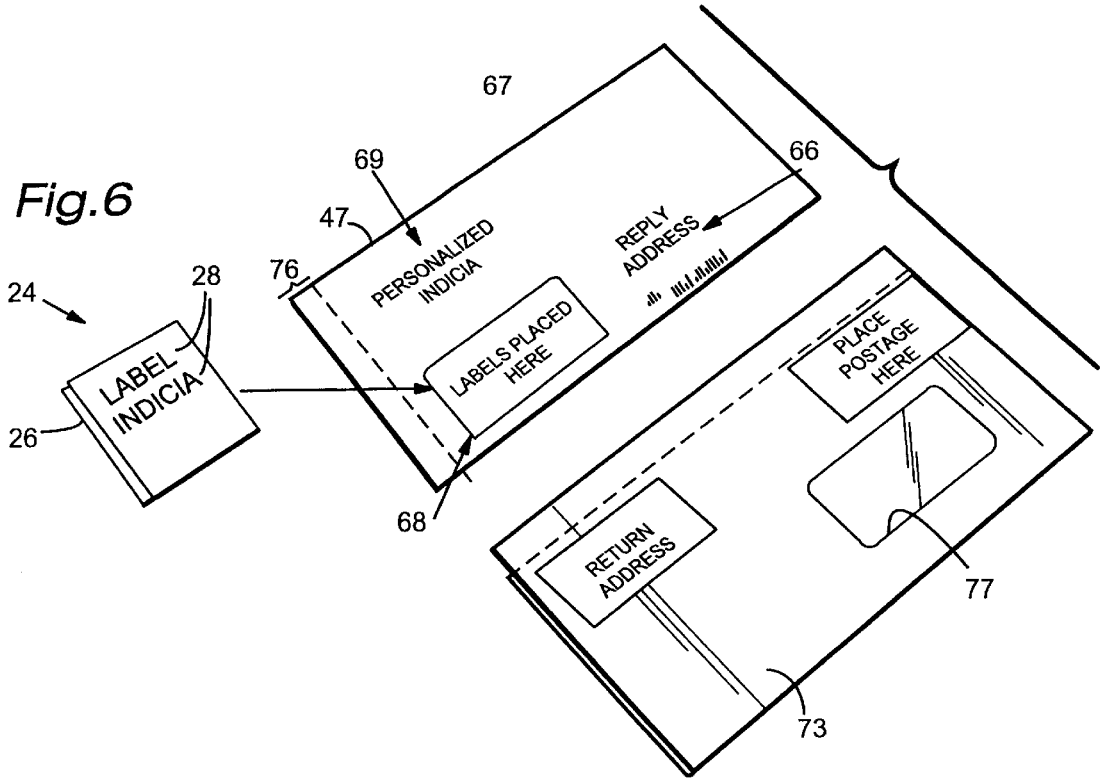
Fig.6
Fig.7
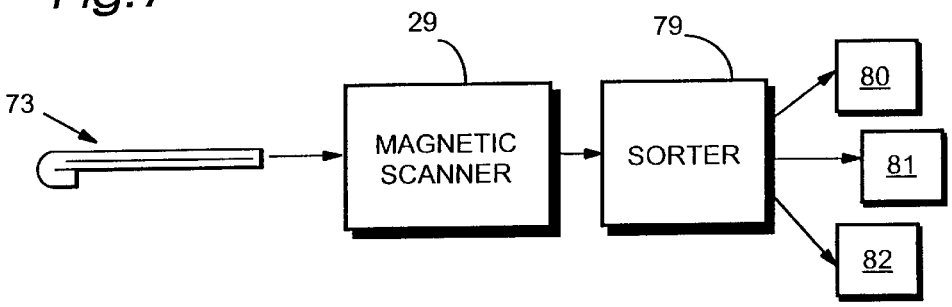

TWO WAY MAILED DOCUMENT WITH TWO SIDED VARIABLE COLOR INFORMATION

This is a divisional of application Ser. No. 08/773,331, filed Dec. 24, 1996, now U.S. Pat. No. 5,921,065 issued Jul. 13, 1999.

BACKGROUND AND SUMMARY OF THE INVENTION

It is common procedure in complicated mailings, such as combined sweepstakes and sales solicitations, to provide a mailing envelope with a large number of paper panels (as the same as separate inserts) within the mailing envelope including a reply panel. The recipient is encouraged to take stickers or labels from one part of the inserts and place them on the reply panel, and then return the reply panel to the organization mailing the envelopes. Typically the reply panel is returned in a reply envelope (e.g. having a window), and when received by the issuing organization the envelopes must be individually opened, inspected to see if any stickers or labels, or which stickers and labels, have been placed thereon, and then the inserts are directed to the correct division within the organization for providing goods or services to the replier depending upon the stickers or labels utilized.

The insert or inserts provided for such mailing envelopes typically require color printing on both faces thereof because it is essential that they make a good impression on the recipient in order to obtain an appropriate level of response. Normally this is accomplished, in actual practice, by printing a document with variable color indicia on both faces of a substrate in a number of press runs, with separate passes through variable data printers to apply other variable information. This procedure limits the number of variations allowed, and is very expensive. Also a number of separate runs are necessary to produce separate insert pieces which then have to be assembled in order. That introduces a number of errors into the procedure.

According to the invention a method, and product, are provided which overcome the drawbacks associated with the prior art procedures in mailing as described above.

According to the invention a document is produced by a procedure which includes imaging (e.g. printing) variable color indicia on both faces of a paper substrate, e.g. such as using an XLC/Xeicon® DCP1 system, and printing sense marks to be used to reinsert the documents ultimately produced from the substrate into a next operation. The substrate is rewound onto a roll, and the roll is taken to a finishing location where it is unwound. The web is trimmed to width size (which removes the sense marks) and scannable indicia is printed on a series of label portions using flexographic magnetic ink. A placer may be used to cut and place strips of transfer tape on the back face of the label portions, and die cutting is used to die cut around the labels through the substrate but not through the transfer tape release liner. A cut off unit then cuts the documents to length, and a buckle folder folds the document to provide up to six panels. The folded sheets are then delivered onto a conveyor and shingled.

The shingled sheets from the conveyor are fed to an inserter machine where one edge of the folded document is trimmed off resulting in a number of loose inserts which are inserted into an outgoing envelope with other inserts, including a reply envelope. By trimming at the inserted document integrity is not compromised. The envelopes are then mailed to end users.

The end user may remove any number of labels from the portion of the inserts where the labels with magnetic indicia are located, and may place the labels on the reply portion of the inserts to indicate a desire to purchase specific items or services, or to provide some other instruction. The reply portion is then inserted into the return envelope and mailed back to the issuing organization. The return labels can then be scanned through the reply envelope itself, without opening them, to determine what the end user wants to buy, and to sort the reply portions into the appropriate classifications.

The invention may be practiced utilizing commercially available equipment, with a wide variety of options being possible. According to one specific aspect of the present invention a method of making a mailing envelope with a plurality of inserts, using a substrate web having first and second faces, is provided. The method comprises the steps of: (a) Imaging variable color indicia on both faces of a substrate web, and imaging sense marks on at least one face of the web, and reply indicia. (b) Using the sense marks, properly aligning and slitting the substrate web into a web of predetermined width. (c) Flexographically printing label portions of the first face of the web with magnetic ink. (d) Applying adhesive and a release liner to the second face of the web at the label portions. (e) Die cutting labels from the label portions. (f) Cutting the web into sheets of predetermined length, each sheet including at least one set of labels. (g) Buckle folding the sheet to form a folded sheet with a plurality of panels in the sheet, at least one panel having a set of labels. (h) Trimming the folded sheet to form at least two distinct inserts from the folded sheet, at least one distinct insert comprising a reply insert with reply indicia thereon. And, (i) inserting the inserts and a reply envelope into an outgoing envelope to produce a mailing envelope.

The invention may also comprise the further steps of (j) imaging instructional indicia on each sheet indicating that one or more labels should be removed from the release liner and placed on a predetermined portion of the reply insert, and the reply insert should be inserted into the reply envelope; and (where the reply envelope is a window envelope having a window) also (k) imaging reply address indicia on the reply insert at a location thereon so that when the reply insert is inserted into the reply envelope the reply indicia is visible through the window. Steps (j) and (k) may be practiced substantially simultaneously with step (a), or at other locations after step (a) but before step (g). Step (g) may be practiced to provide between three and six panels in the sheet, e.g. to provide at least four panels including at least two aligned fold lines, and step (h) may be practiced to sever the sheet of the aligned fold lines to form at least three different inserts.

There typically also are the further steps, between steps (a) and (b), of winding the web into a roll, transporting the roll to another location, and unwinding the web from the roll.

Step (g) may be practiced to provide between three and six panels in the sheet. Step (h) may be practiced to sever the panels so as to substantially simultaneously remove the first and third fold lines. The severing in step (h) preferably takes place at substantially the same location as step (i), so that document integrity is not compromised.

There may also be the further steps of receiving a plurality of reply envelopes, at least some of which have at least one label with magnetic ink thereon disposed on a reply insert therein, at a reply location; without opening the reply envelopes passing them through a sensor to sense relevant information on labels therein at the reply location; and sorting the reply envelopes in response to the sensing.

According to another aspect of the present invention a method of producing envelope inserts using a substrate web having first and second faces is provided. The method comprises the steps of: (a) Imaging indicia, including variable color indicia, on both faces of a substrate web, the indicia also including reply indicia. (b) Cutting the printed web into sheets of predetermined length. (c) Buckle folding the sheet to form a folded sheet with at least four panels in the sheet, including at least two aligned fold lines. And, (d) trimming the folded sheet to sever the sheet at the aligned fold lines to form at least three distinct inserts, at least one distinct insert comprising a reply insert with reply indicia thereon. Step (c) is preferably practiced to provide a folded sheet having first through sixth consecutively disposed panels, the first and sixth panels having free edges substantially parallel to five consecutive fold lines separating the sheet into panels, the first fold line between the first and second panels and the fifth fold line between the fifth and sixth panels; the panels disposed in order as the second, first, fourth, fifth, sixth and third. Step (d) is also preferably practiced to sever the panels so as to substantially simultaneously remove the first and third fold lines, to create distinct inserts.

According to yet another aspect of the present invention an intermediate for inserts into an envelope is provided. The intermediate comprises a folded sheet having first through sixth consecutively disposed panels, the first and sixth panels having free edges substantially parallel to five consecutive fold lines separating the sheet into panels. The first fold is between the first and second panels and the fifth fold line is between the fifth and sixth panels. The panels are disposed in order as the second, first, fourth, fifth, sixth, and third. The sheet has first and second faces with indicia thereon, including color indicia on each face, and at least one of the panels has reply indicia thereon. Inserts may be formed from the intermediate by severing the panels to remove the first and third fold lines.

It is the primary object of the present invention to provide a simple yet effective method for constructing desirable documents, in an intermediate form thereby. This and other objects of the invention will become clear from an inspection of the detailed description of the invention, and from the appended claims.

BRIEF DESCRIPTION OF THE DRAWINGS

FIG. 5 is a schematic view, partly in cross-section and partly in elevation, showing the construction of a label on the inserts of FIG. 3;

FIG. 6 is a top perspective view showing an exemplary label, reply panel, and reply envelope, retrieved from the mailing envelope according to the invention after it is opened by the end user; and FIG. 7 is a schematic illustration of the method of scanning and sorting reply envelopes such as those of FIG. 6 when received by the organization originally issuing the mailing envelopes.

DETAILED DESCRIPTION OF THE DRAWINGS

Figure 1:
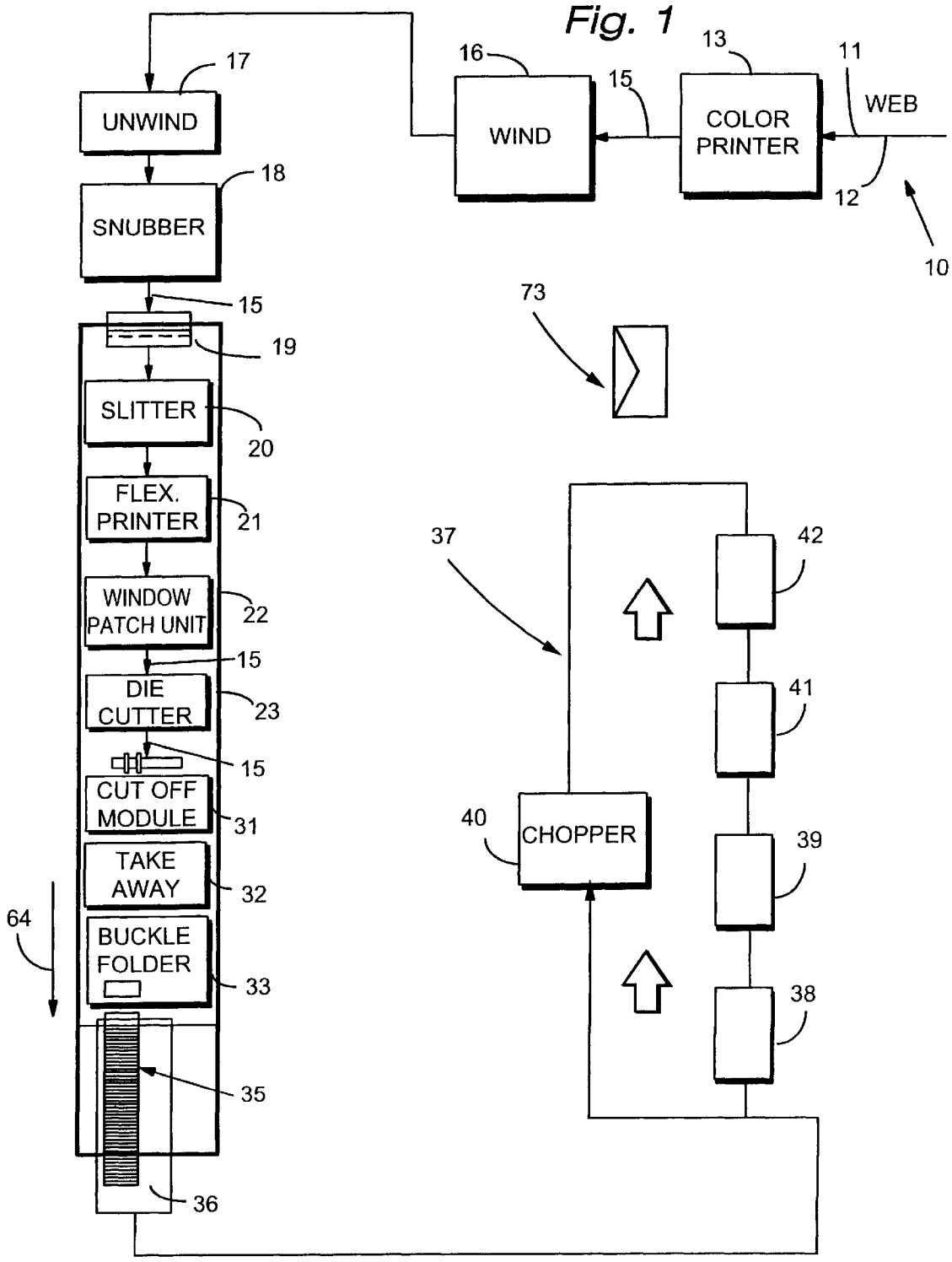
FIG. 1 is a schematic diagram illustrating the practice of various steps in an exemplary method according to the present invention.

FIG. 1 illustrates exemplary apparatus and method steps for practicing the method of making a mailing envelope with a plurality of inserts, according to the present invention. The method is practiced utilizing a substrate web 10 having first and second faces 11, 12. The web 10 is imaged on both faces 11, 12 including with color indicia, e.g. utilizing a conventional color printer 13. While the color printer 13 may take a wide variety of forms it may be, for example, a Xeicon® DCP-1, available from Xeicon N.V. of The Netherlands, short run digital color press. The printer 13 preferably is controlled by using an XLC® data system, available from Moore Business Communications of Lake Forest, Ill. Conventional sense marks are preferably also printed on the web 10 at the same time for facilitating proper orientation and handling of the web 10 in subsequent steps. While the indicia printed web 15 may be fed directly to subsequent operations, preferably it is wound into a roll using a conventional winder 16, and the roll is then transported to another location where the roll is unwound using a conventional unwinder 17. The web 15 may be characterized as intelligently electronically preprinted stock which is then run, from unwinder 17, roll to roll with sense marks and sequential numbering.

From the unwinder 17 the web 15 may be passed through a conventional snubber 18, through a conventional manufacturing registration system 19, which senses the sense marks and controls subsequent operations based upon that sensing, and a conventional slitter 20. The slitter 20 trims the side edges of the web 15, including trimming off the sense marks, to provide a web of predetermined width.

From the slitter 20 the web 15 is passed to a conventional flexographic print unit 21 which flexographically prints label portions on the first face or back 11 of the web 15 with magnetic ink. The labels will ultimately be formed from the label portions so printed. The flexographic print unit 21 may include a spacer module with 360° rotary registration.

From the flexographic print unit 21, the web 15 may pass to a conventional window patch unit 22, e.g. a Ga-Vehren or Tamarack label applicator unit with waste rewind. The unit 22 also preferably includes a spacer module with 360° rotary registration. At the window patch unit 22 pressure sensitive adhesive and a release liner are provided on the second face 12 of the web 15 at the area of the label portions. While the adhesive and release liner may be provided by any suitable mechanism and in any suitable manner, such as shown in U.S. Pat. Nos. 5,129,682, 5,324,153, or 5,482,328, they preferably are applied in the form of transfer tape using a conventional placer.

After the label applicator unit 22 the web 15 is passed to a conventional die cutter 23. The die cutter 23 cuts labels from the label portions, passing through the paper of the web 15 but not cutting the release liner. The die cutter 23 also preferably comprises a spacer module with 360° rotary registration.

After the die cutter unit 23 the web 15 preferably has a construction generally as illustrated in FIG. 5. That is the web 15 has a plurality of label portions, such as the label portion 24 seen in FIG. 5, formed by die cuts 25 in the web substrate 15, with a pressure sensitive adhesive 26 and a release liner 27 overlapping the die cuts 25 and substantially completely covering the second face 12 of the web 15 at the labels 24. In FIG. 5 the thicknesses of the elements are not accurate, but is shown merely for clarity of illustration. Each of the labels 24 may ultimately be detached from the web 15, as also illustrated in FIG. 5, and have a pressure sensitive adhesive backing 26 thereon since the adhesive 26 has a higher affinity for the paper of the label 24 then for the release liner 27. The indicia 28 printed on the first face of the label 24 is at least partially provided by magnetic ink applied at flexographic printer 21. A customer logo may be printed on back of a stamp 24, then covered with transfer tape. The logo may be pretested for correct magnetic ink laydown strength, as determined by scanning equipment (like the equipment 29 in FIG. 7), such as according to the general procedure illustrated and described in U.S. Pat. No. 5,397,623.

After the die cutter 23 the web 15 passes to a conventional cut off module 31, including a cut off take away 32, for cutting the web 15 into sheets of a predetermined length, each sheet including at least one set of labels 24. A wide variety of conventional modules 31 may be utilized, such as one with a PACSCI drive. From the cut off take away 32 the cut sheets pass to a conventional buckle folder 33, such as a six gate buckle folder, where each sheet is folded to form a folded sheet with a plurality of panels in the sheet, at least one panel having a set of labels 24. The folded sheets may then be shingled—as illustrated schematically by intermediate 35 in FIG. 1—using conventional conveyance/shingling equipment, and provided on a conventional delivery table 36.

From the conventional delivery table 36 the folded sheets are transported to a conventional inserter 37. The inserter 37 has a feeder 38 for receipt of the intermediates (shingled folded sheets) 35, and a business reply envelope feeder 39, illustrated schematically in FIG. 1. The inserter 37 also includes a conventional chopper, illustrated schematically at 40, which trims the folded sheets (intermediates 35) to form at least two distinct inserts from each folded sheet, at least one of the distinct inserts comprising a reply insert with reply indicia thereon. By providing this trimming operation utilizing the chopper 40 at the inserter 37 document integrity is not compromised, as could possibly be the case if trimming were practiced significantly before the inserter 37.

The inserter 37 feeds the trimmed inserts, utilizing the feeder 38, in the work direction illustrated in FIG. 1. Another insert feeder 41 may be provided, as well as an outgoing envelope feeder 42. At some point after insertion of all of the inserts the outgoing envelope is sealed utilizing conventional sealing equipment (the equipment dependent upon the type of adhesive on the outgoing envelope, to produce final outgoing mail piece 73, as described below).

Figure 2:
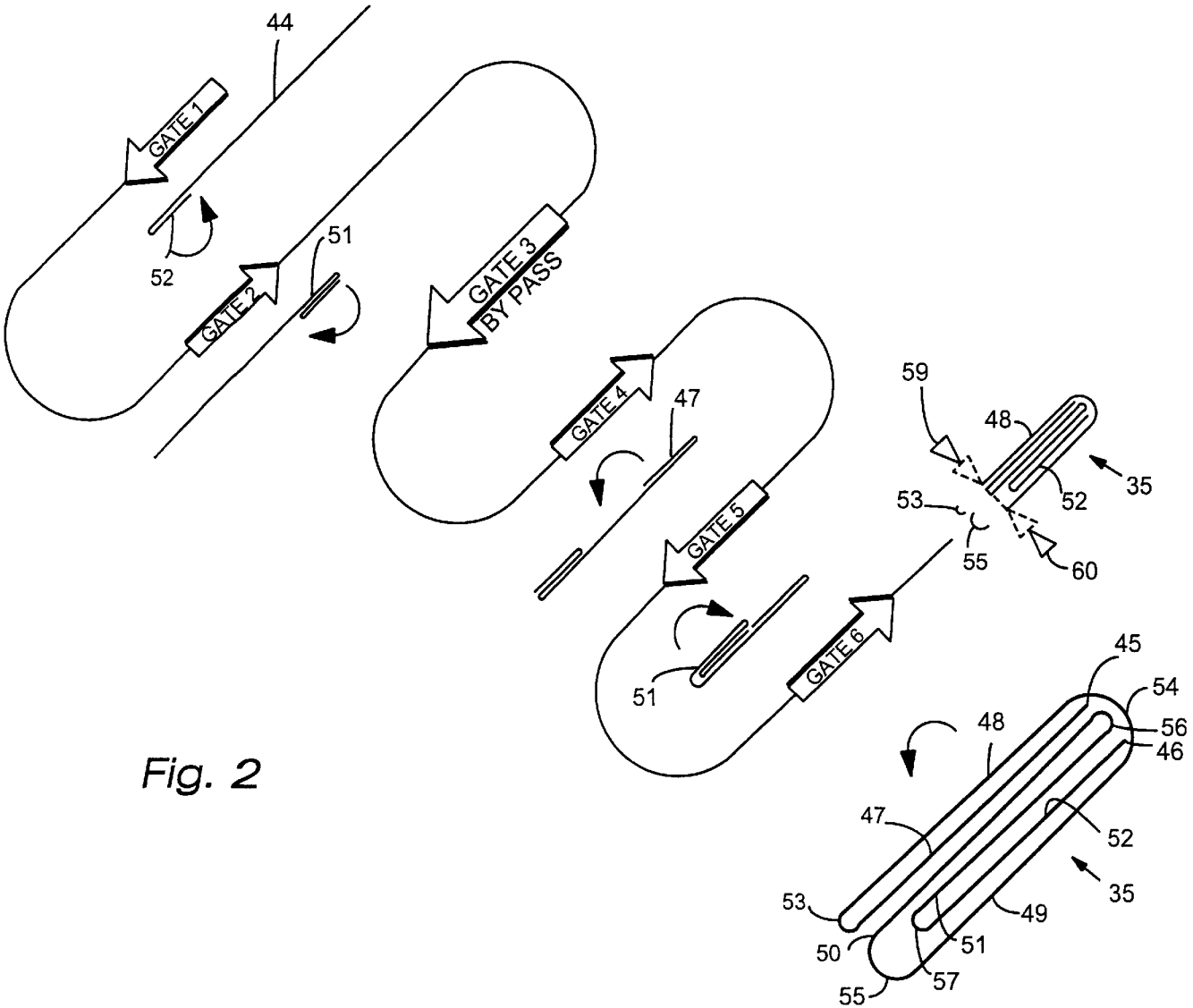
FIG. 2 is a schematic view illustrating the manner in which an insert intermediate is produced by buckle folding according to the present invention, and then severing at fold lines.

FIG. 2 schematically illustrates the manner in which the buckle folder 33 operates on a sheet 44 from the cut off module 31 to produce a folded sheet 35. FIG. 2 illustrates the preferred embodiment in which the folded sheet 35 has six panels (first through sixth panels) with parallel end edges and five parallel fold lines (first through fifth fold lines). For example as seen in FIG. 2 the folded sheet 35 has first and second parallel end edges 45, 46, respectively, has first through sixth panels shown by reference numerals 47 through 52, respectively, the first panel 47 having the end edge 45 and the sixth panel 52 having the end edge 46; and first through fifth fold lines, shown by reference numerals 53 through 57, respectively, the first fold line 53 being between the first and second panels 47, 48, the second fold line 54 being between the second and third panels 48, 49, respectively, etc. At least two of the fold lines (e.g. the fold lines 53, 55) are aligned. In FIG. 2 the folded sheets 35 are clearly only schematically shown with greatly exaggerated spacing between the panels, simply for clarity of illustration.

As schematically illustrated in FIG. 2, at the buckle folder 33 first gate the sixth panel 52 may be formed, while in the second gate the fifth panel 51 is formed, gate three may be bypassed, and in gate four the first panel 47 is formed. In the fifth gate the fourth panel 51 is formed, while in the sixth gate the second panel 48 and third panel 49 are formed. While the schematic of FIG. 2 illustrates a preferred embodiment according to the invention, it is to be understood that other types of inserts and folded sheets may be provided according to the invention, but would typically have at least three panels with a maximum of seven panels (when using a six gate folder 23).

FIG. 2 also schematically illustrates the trimming operation performed by the chopper 40, such as utilizing blades 59, 60, that operation performed at the inserter 37. In the preferred embodiment illustrated in FIG. 2 the folded sheet 35 is trimmed so that the first and third fold lines 53, 55 are removed, preferably substantially simultaneously since they are aligned. This produces, in the preferred embodiment illustrated, three distinct inserts from the folded sheet 35, such as the inserts 61, 62 and 63 illustrated in FIG. 3.

While the general procedure for forming inserts 61 through 63 according to the invention has been illustrated in FIGS. 1 and 2, it is to be understood that a wide variety of other additional or alternative steps may be utilized. For example perfing equipment may be utilized to form perforations at some of the fold lines (e.g. the fold line 54) if desired, or to form perforations at other locations in any of the inserts 61 through 63 either in the direction of web movement illustrated in FIG. 1 generally by the arrow 64, or as substantially transverse to the direction 64. Also other imaging or adhesive applying equipment may be utilized.

Figure 3:
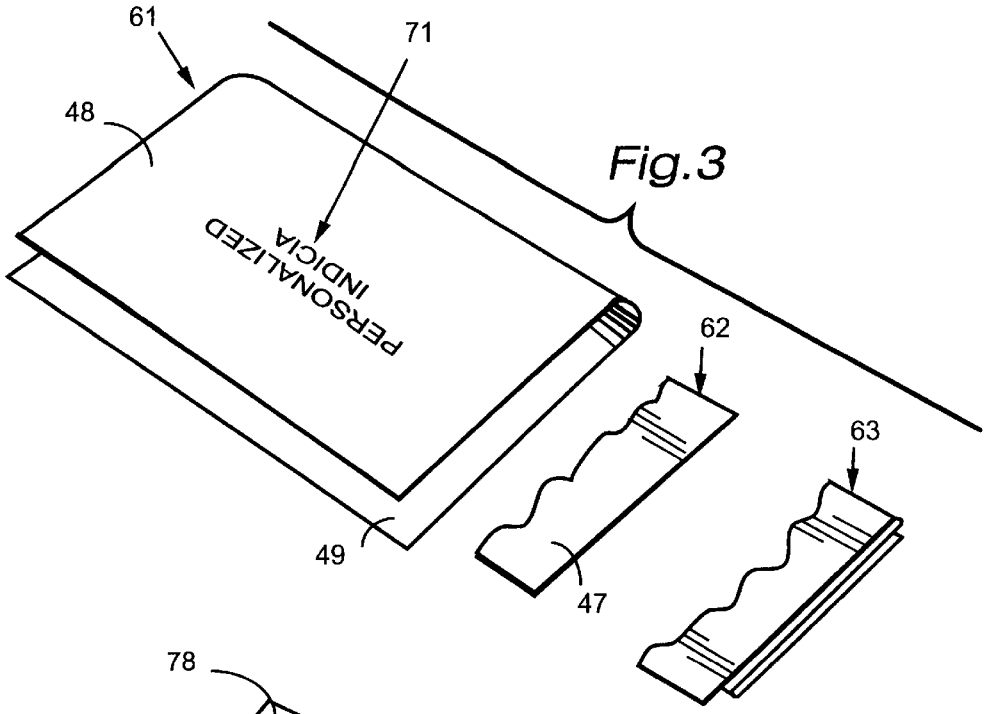
FIG. 3 is a top perspective schematic exploded view of the inserts formed utilizing the method procedure schematically illustrated in FIG. 2.

While the inserts 61 through 63 may take a wide variety of forms, in the exemplary embodiment illustrated in FIG. 3 the first insert 61—formed from the second and third panels 48, 49—may comprise a personalized cover letter, the personalized indicia thereon having been printed at the color printer 13 under the control of the computer control such an XLC control. The reply insert 47—as illustrated in FIG. 6—preferably has reply indicia thereon. While this reply indicia may take a wide variety of forms, it typically includes reply address indicia (including bar coding) shown schematically and generally at 66 in FIG. 6. Most desirably the reply insert 47 has conventional indicia 68 thereon indicating that labels (or stickers if instead of using pressure sensitive adhesive and a release liner a patch coating of rewettable adhesive is provided on the backs of the labels 24) indicating that the labels 24 should be placed at the indicia 68, so that they are at a predetermined location on the insert 47. The end user then removes one or more labels 24 from the third insert 63, and presses the pressure sensitive adhesive 26 associated therewith at the proper location indicated by the indicia 68. The reply insert 47 also includes personalized indicia 69 thereon so that the end user returning the reply insert 47 is readily identified.

The insert 63 preferably comprises a personalized promotional flyer. On at least one of the panels of the insert 63 a set of labels 24 is provided.

Figure 4:
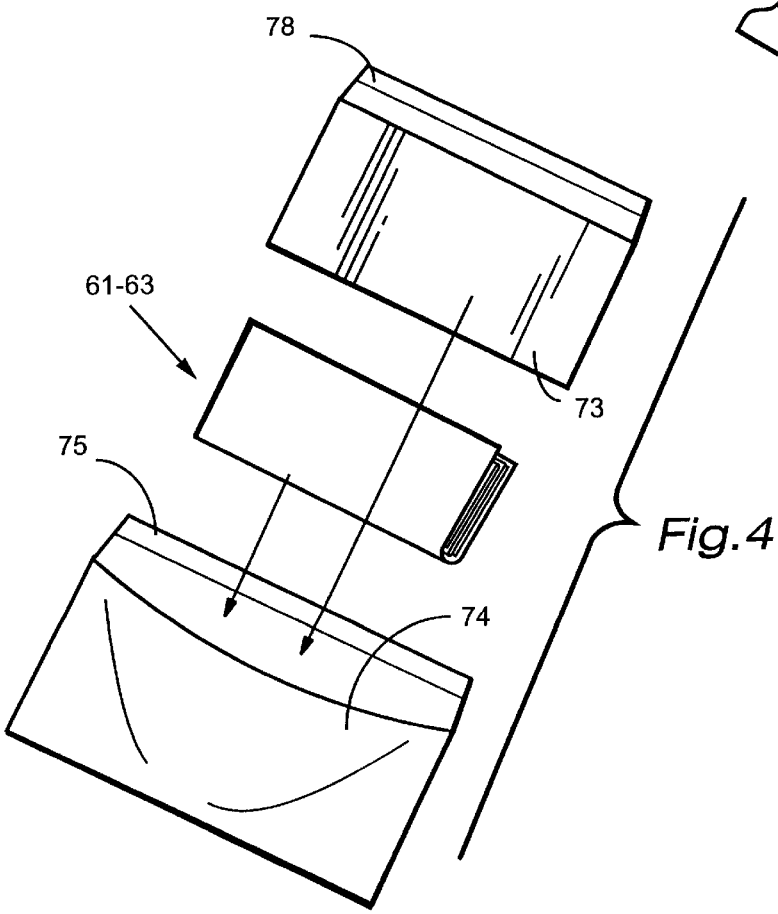
FIG. 4 is a top perspective view schematically illustrating the insertion of the inserts of FIG. 3 and a reply envelope in an outgoing envelope.

FIG. 4 schematically illustrates the insertion of the inserts 61 through 63, at the inserter 37, preferably along with a reply envelope 73 (of conventional construction) into an outgoing envelope 74 (also of conventional construction). The outgoing envelope 74 may be a window envelope so that personalized address indicia—such as shown only very schematically at 71 in FIG. 3—is visible through the window of the outgoing envelope 74. The outgoing envelope 74 may have a suitable flap with adhesive 75 thereon, the adhesive of any type (e.g. pressure sensitive, pressure cohesive, rewettable, heat activated, etc.) which is sealed using conventional sealing equipment.

In the preferred embodiment, the end user inserts the reply insert 47, typically with one or more labels 24 thereon, in the reply envelope 73. The reply insert 47 may have a readily removable portion 76 which is removed by the recipient (according to instructions also imaged on the reply insert 47) so that it easily fits in the envelope 73 and the reply address information 66 is preferably positioned with respect to a window 77 in the reply envelope 73. After the reply insert 47 is properly inserted into the reply envelope 73, a flap of the reply envelope 73 with the adhesive 78 (see FIG. 4) thereon is sealed. The adhesive 78 may comprise any suitable type, such as rewettable, pressure sensitive adhesive.

When the sealed reply envelope 73 is received by the organization initially sending out the outgoing envelope 74, as illustrated schematically in FIG. 7, a plurality of envelopes 73 may be automatically passed through a conventional magnetic scanner 29, such as described with respect to U.S. Pat. No. 5,397,623. The scanner 29 detects magnetic ink from one or more labels 24 if present within the sealed reply envelope 73, and then a conventional sorter 79 sorts the envelopes 73 depending upon what is detected by the scanner 29. For example envelope 73 with no labels 24 may be classified in a first area 80, while envelope 73 with particular labels 24 may be classified in any number of areas, such the areas 81 and 82 schematically illustrated in FIG. 7.

It will thus be seen that according to the present invention an advantageous method of making a mailing envelope 74 with a plurality of inserts 61–63, 73, has been provided, as well as a method of producing envelope inserts 61–63, per se, and an intermediate 35 for the production of inserts 61–63. While the invention has been herein shown and described in what is presently conceived to be the most practical and preferred embodiment it will be apparent to those of ordinary skill in the art that many modifications may be made thereof within the scope of the invention, which scope may be accorded the broadest interpretation of the appended claims so as to encompass all equivalent methods and products.

What is claimed is:

1. An intermediate for inserts into an envelope, comprising: a folded sheet having first through sixth consecutively disposed panels, the first and sixth panels having free edges substantially parallel to first through fifth consecutive fold lines separating the sheet into panels, the first fold line between the first and second panels and the fifth fold line between the fifth and sixth panels; the panels disposed in order as the second, first, fourth, fifth, sixth and third; said sheet having first and second faces with indicia thereon, including at least some color indicia on each face, and at least one of said panels having reply indicia thereon.

2. Inserts formed from the intermediate of claim 1, by severing the panels to remove the first and third fold lines.

3. An intermediate as recited in claim 1 wherein at least one of the panels comprises label portions having adhesive covered by a release liner.

4. An intermediate as recited in claim 3 wherein said label portions have magnetic ink forming indicia thereon on a face thereof opposite said release liner.

5. An intermediate as recited in claim 4 further comprising instructional indicia on at least one panel indicating that one or more labels should be removed from said release liners and placed on a predetermined portion of said panel.

6. An intermediate as recited in claim 5 further comprising reply address indicia on at least one of said panels, said reply address indicia readable through a window in a reply envelope in which said panel is inserted.

7. An intermediate as recited in claim 3 further comprising reply address indicia on at least one of said panels, said reply address indicia readable through a window in a reply envelope in which said panel is inserted.

8. An intermediate as recited in claim 1 further comprising reply address indicia on at least one of said panels, said reply address indicia readable through a window in a reply envelope in which said panel is inserted.

9. Inserts formed from the intermediate of claim 3, by severing the panels to remove the first and third fold lines.

10. Inserts formed from the intermediate of claim 4, by severing the panels to remove the first and third fold lines.

11. Inserts formed from the intermediate of claim 5, by severing the panels to remove the first and third fold lines.

12. Inserts formed from the intermediate of claim 6, by severing the panels to remove the first and third fold lines.

13. Inserts formed from the intermediate of claim 8, by severing the panels to remove the first and third fold lines.

14. An intermediate as recited in claim 1 wherein said color indicia on each face comprises variable color indicia.

15. An intermediate as recited in claim 4 wherein said color indicia on each face comprises variable color indicia.

16. Inserts formed from the intermediate of claim 4, by severing the panels to remove the first and third fold lines.

17. Inserts formed from the intermediate of claim 15, by severing the panels to remove the first and third fold lines.

* * * * *